United States Patent [19]

Volz

[11] 4,385,415

[45] May 31, 1983

[54] CASTER ASSEMBLY FOR SUITCASES AND THE LIKE

[76] Inventor: Richard Volz, Obere Hurststrasse 9, 7144 Asperg, Fed. Rep. of Germany

[21] Appl. No.: 239,688

[22] Filed: Mar. 2, 1981

[30] Foreign Application Priority Data

Mar. 1, 1980 [DE] Fed. Rep. of Germany ..... 3007863
May 19, 1980 [DE] Fed. Rep. of Germany ..... 3018994

[51] Int. Cl.[3] ..... B60B 33/00; A45C 5/00
[52] U.S. Cl. ..... 16/29; 190/18 A
[58] Field of Search ..... 16/47, 29, 19; 190/18 A

[56] References Cited

U.S. PATENT DOCUMENTS 2,810,925 10/1957 Meyerhoefer ..... 16/18 CG
3,537,721 11/1970 Warner, Jr. ..... 16/18 R

FOREIGN PATENT DOCUMENTS 1581310 12/1980 United Kingdom ..... 190/18 A

*Primary Examiner*—Doris L. Troutman
*Attorney, Agent, or Firm*—Joseph A. Geiger

[57] ABSTRACT

A caster assembly adapted for incorporation in the frame of a suitcase, the caster assembly comprising a caster housing with a housing recess enclosing a major portion of the swivelable caster wheel, housing side walls limiting its swivel range, and a swivel bearing with a stationary journal plate attachable to the bottom wall of the caster housing by means of a slot-engaging protrusion and rivets. The caster housing may be an integral part of the suitcase frame.

10 Claims, 13 Drawing Figures

CASTER ASSEMBLY FOR SUITCASES AND THE LIKE

BACKGROUND OF THE INVENTION

1. Field of the Invention

The present invention relates to suitcases and other heavy luggage cases, and, more particularly, to suitcases which are equipped with built-in casters on which they can be wheeled from place to place.

2. Description of the Prior Art

Suitcases of average or larger than average dimensions, when fully packed, may be so heavy that the user is faced with considerable strain and fatigue, if he is to carry one, or maybe even two of them from his residence to his means of transportation, or vice versa, or from one means of transportation to another at a transfer station.

This problem has already led to the development of suitcases which have casters arranged in pairs on the lower longitudinal side, opposite the carrying handle of the suitcase, or near the corner between the lower longitudinal side and one of the two transverse sides. To the extent that only one pair of casters is used, the caster wheels need not be swivelable for a change in direction. Where two caster pairs are arranged on the lower longitudinal side of the suitcase, one or both pairs of casters have caster wheels that are swivelable about a vertical axis.

Suitcases with a single pair of casters at a bottom corner are in most cases equipped with an auxiliary carrying handle or guide handle at the opposite corner. This handle may be of the type which is extendable and retractable or pivotably attached to the suitcase. The user of such a suitcase has to lift it on one side with the aid of the auxiliary handle, thereby carrying a portion of the weight of the suitcase himself. In contrast, when the suitcase is equipped with four caster wheels, its entire weight is carried by the wheels, and the suitcase is displaced by pulling on its carrying handle, in a stooped posture, or by pulling on a special pull strap attached to the case. The caster assemblies are in most cases rigidly mounted on the outside of the frame of the suitcase. In this mounting arrangement, even caster assemblies with very small wheels will protrude by their full height over the outline of the suitcase frame, with the resultant risk that, when the suitcase encounters a doorstep or a depression in the floor, its caster wheels become caught and damaged, or even torn off, thereby frequently also causing damage to the suitcase frame itself. This disadvantage is also present, when such a suitcase is handled in a check room or when it is placed on a luggage cart or into a container, where it may have to be pushed onto a ledge or on top of other luggage pieces and later pulled off again.

In a known caster arrangement, disclosed in U.S. Pat. No. 3,948,365, the above-mentioned difficulties are largely avoided, inasmuch as a non-swivelable caster wheel is rotatably supported in a plastic housing which forms a recess for the caster wheel, so that the housing partially encloses the caster wheel in a hood-like fashion from the side opposite its contact point with the floor. The recess of the housing is surrounded by a flange-like collar and is shaped to match the curvature of the rounded corner portion of the suitcase between the lower longitudinal side and one of its two transverse sides. In this corner area, the suitcase frame has two openings arranged side-by-side into which the hood-shaped caster housings are inserted in such a way that their flange-like collars abut against the outer side of the suitcase frame. The collars of the housings are permanently attached to the suitcase frame, using rivet fasteners, for example, near the two longitudinal extremities of the housing collar. The fact that these caster wheels have a comparatively large diameter, on the one hand, and are to a large extent recessed into the suitcase frame, on the other hand, results in a comparatively shallow rise of the peripheral surface of the caster wheels from the longitudinal side and from the transverse side of the suitcase.

Up to the present, however, such an advantageous configuration has only been obtained in the corner area of the suitcase, where the latter has a single pair of non-swivelable casters. The suitcase needs to be tilted upwardly, in order to become steerable. On any other point of the suitcase contour, the space requirements for similar caster assemblies, which would then have to consist of two caster pairs, would be too large. Furthermore, the mere provision of two pairs of casters would not provide the required steerability, unless at least one pair of casters is swiveled. The limitation to one caster pair at the corner of the suitcase means, on the other hand, that the user of such a suitcase will have to carry a significant portion of the weight of the suitcase himself.

From French Pat. No. 72 18 946 is known an arrangement of caster assemblies where each assembly has a swivelable caster wheel which is rotatably supported in a bearing bracket. The latter is attached to the bottom of a recessed caster housing by means of a swivel bearing. Like conventional exposed swivel casters, these caster wheels are free to swivel over 360°. They therefore require a caster housing with a recess of a size that will limit its use to the closed longitudinal side of travel trunks of a certain minimal size, given the necessity of the swivelable caster wheels not to be smaller than a predetermined diameter below which they would not be suitable for the intended application. For conventional hand-carried suitcases, especially cases of the type which have approximately identical cover and bottom shells opening along a central plane, these caster assemblies are not suitable, because they would require such large openings in the suitcase frame for the caster housings that the strength and rigidity of the frame would no longer be adequate.

SUMMARY OF THE INVENTION

Underlying the present invention is the primary objective of providing an improved caster assembly for suitcases or other heavy luggage cases, which features a rolling support that protrudes only minimally over the outline of the case, providing four points of support and steerability of the case, with a minimum of space required for the caster assembly inside the suitcase and also a minimal opening in the suitcase frame, so as to preserve the strength of the latter.

The present invention proposes to attain this objective by suggesting a caster assembly in which a caster housing with a deep recess encloses the caster wheel to such an extent that a major portion of the diameter of the caster wheel is recessed within the housing, while the latter, in turn, is recessed in an opening of the suitcase frame, so that the exterior protrusion of the caster wheel is sufficiently small to prevent the wheel from being caught on a step or hole in the supporting surface.

The recessed caster wheel is attached to the caster housing by means of a swivel bearing, thereby providing steerability, so that three or more—preferably four—casters can be employed. The present invention further suggests that the swivel range of the caster wheels be restricted to a comparatively small swivel angle, thereby making it possible to greatly reduce the dimensions of the housing in both the longitudinal and the transverse sense, so that the interior space of the suitcase is only minimally encumbered and only a small opening is necessary in the suitcase frame.

Because the caster housing of the invention is not much larger than a caster housing for a non-swivelable caster wheel, it now is possible to use the novel swivel caster assembly in conjunction with the type of suitcase which, at present, is widely preferred, viz. a suitcase which has bottom and cover shells of substantially the same height, and where the caster housings are recessed into frame openings which are small enough that, in spite of these openings, the suitcase frame retains sufficient strength and rigidity. By limiting the caster swivel range to as little as 60 degrees, for example, it is possible to obtain a good strength of the suitcase frame, while providing a surprisingly good steerability, so that the applicability of the invention is extendable to suitcases of comparatively small height.

The caster housing is preferably a deep-drawn sheet metal part, but it may also be produced as an injection-molded part, using plastic material of high resistance. Alternatively, it is also possible, and in some cases preferable, to produce the caster housing as an integral wall portion of the suitcase shell, especially when the latter is of the molded type. The swivel bearing of the caster wheel is preferably a ball bearing, the balls being retained in ball races which are formed in the bearing bracket and in the bottom wall of the caster housing, or in a separate stationary journal plate which is attached to the bottom of the caster housing.

The provision of a journal plate for the swivel bearing makes it possible to preassemble the caster wheel with the swivel bearing, so that the final assembly with the caster housing requires only a riveting operation, or some other suitable connection between the journal plate and the housing bottom. Accordingly, the present invention further suggests that the journal plate be provided with a tongue-shaped protrusion which is designed to engage a matching slot of the caster housing in the immediate vicinity of the swivel bearing, in combination with rivets which attach the journal plate to the housing bottom, where the latter provides more space, due to the space requirements of the swiveling caster wheel. The journal plate is preferably a simple sheet metal stamping. In cases where it is advantageous to manufacture the caster housing as a separate part, the latter is preferably provided with a flange and attached to the suitcase frame by means of rivets.

In a preferred embodiment, the present invention further suggests the provision of abutment means between the bearing bracket of the caster wheel and the side walls of the caster housing, in order to assure that the caster wheel will not rub against the housing side walls.

BRIEF DESCRIPTION OF THE DRAWINGS

Further special features and advantages of the invention will become apparent from the description following below, when taken together with the accompanying drawings which illustrate, by way of example, several embodiments of the invention which are represented in the various figures as follows.

DESCRIPTION OF THE PREFERRED EMBODIMENTS

Figure 1:
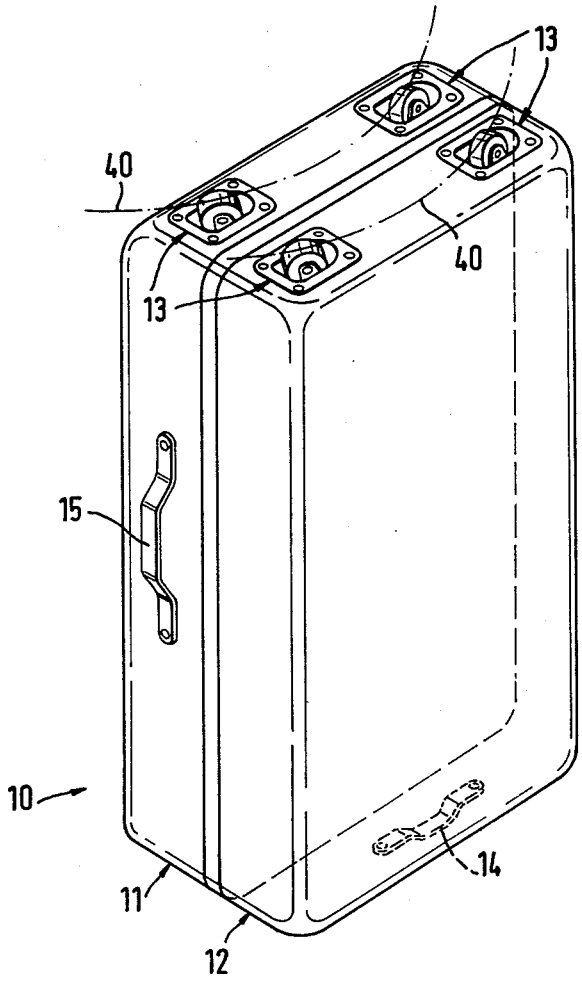
FIG. 1 is a perspective view of a suitcase with four swivelable casters arranged on one of its transverse sides, as suggested by the present invention.

The suitcase 10 which is illustrated in FIG. 1 in a somewhat simplified manner is seen to consist of a bottom half 11 and a cover half 12, the suitcase having arranged on one of its end faces four caster assemblies 13 which will be described in full detail below with reference to the drawing figures.

The four caster assemblies are so arranged on the transverse sides of the bottom half 11 and cover half 12 that they are spaced as far apart as possible, in order to optimize the stability of the suitcase against tipping over. The suitcase 10 of FIG. 1 is actually shown in an upside-down position, merely to better show the four caster assemblies 13. On the opposite transverse side—which normally faces upwardly—is arranged an auxiliary handle 14 by means of which the suitcase can be displaced and guided, when it rests on its caster assemblies 13. A carrying handle 15 on the longitudinal side with the locks (not shown) serves to carry the suitcase in the conventional manner, the hinges (likewise not shown) which connect the cover half 12 with the bottom half 11 being arranged on the opposite longitudinal side of the suitcase.

Figure 2:
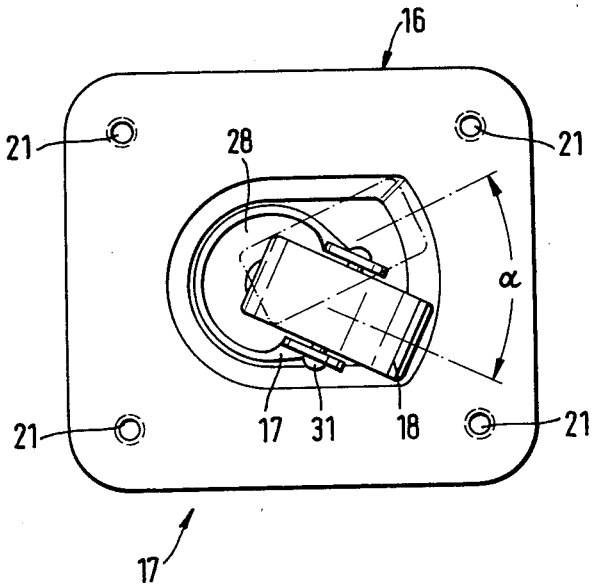
FIG. 2 shows a caster assembly, seen from below, in accordance with the invention.
Figure 3:
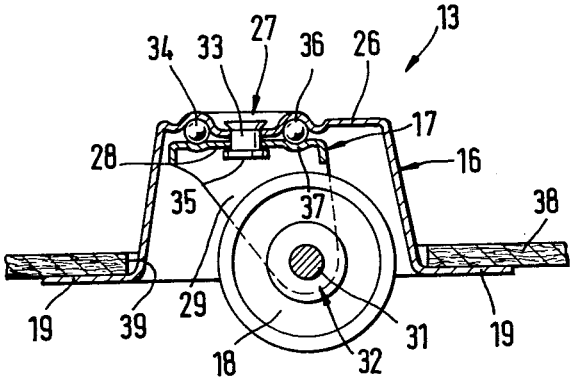
FIG. 3 is a longitudinal cross section of the caster assembly of FIG. 1.

The caster assembly 13 which is shown in detail in FIGS. 2 and 3 features a caster housing 16 and a caster wheel 18 which is supported on the housing 16 by means of a swivelable bearing bracket 17.

Figure 4:
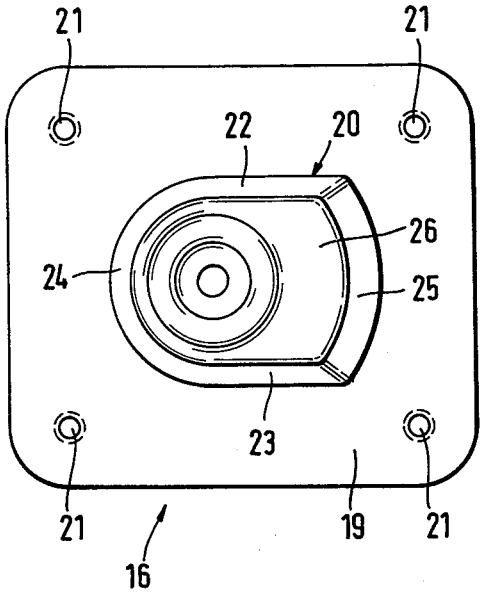
FIG. 4 shows the caster housing of the caster assembly of FIG. 1, as seen from below.
Figure 5:
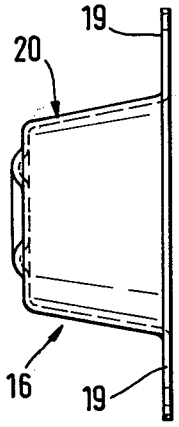
FIG. 5 is a side view of the caster housing of FIG. 4.
Figure 6:
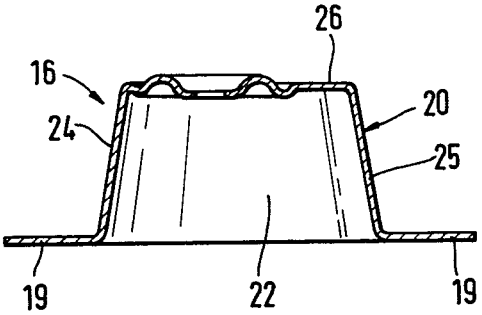
FIG. 6 is a longitudinal cross section of the caster housing of FIG. 4.

As can best be seen in FIGS. 4 and 6, the caster housing 16 is a deep-drawn sheet metal part, having a flat flange portion 19 surrounding a central housing recess 20. The flange portion 19 has a generally rectangular outline with rounded corners. Near these corners are arranged four attachment bores 21 which, depending on the attachment mode, may be smooth bores or threaded bores. In the latter case, it may be advantageous to use a fabricating method which produces collars on the bores, for a greater thread length.

The housing recess 20 encloses a major portion of the bearing bracket 17 and of the caster wheel 18 in a hood-like fashion (FIG. 3), supporting the bearing bracket 17 with a swivel connection. The housing recess 20 is formed by four contiguous wall portions 22, 23, 24 and 25, and a bottom wall 26. The four wall portions extend almost perpendicularly to the flange portion 19, converging slightly towards the bottom 26. Not considering the influence of this wall taper on the overall wall outline and the transition radii between walls, the two opposite side wall portions 22 and 23 are flat, the front wall portion 24 is semi-cylindrical in shape, and the rear wall portion 25 is shaped like a cylinder segment. The centers of the semi-cylinder and cylinder segment of the wall portions 24 and 25 coincide with the axis of the swivel bearing 27 of the bearing bracket 17 (FIG. 3). The two side wall portions 22 and 23 are spaced approximately 35 mm apart, thus giving the caster wheel 18 a swivel range $\alpha$ of approximately 60°. For larger suitcases, it may be preferable to modify the housing recess in such a way that the swivel range $\alpha$ is increased. However, it should not be made greater than 90°, in order to limit the width of the opening in the suitcase frame to no more than 40 mm. This configuration of the wall portions of the housing recess 20 makes it possible to attain an optimal utilization of the recess space for the components of the bearing bracket 17 and a caster wheel 18, or, expressed differently it achieves the smallest dimensions of the housing recess 20 for a given set of dimensions of the bearing bracket 17 and caster wheel 18, especially in the transverse sense, thereby correspondingly limiting the necessary weakening of the suitcase frame. The interior of the housing recess 20 is determined by the diameter of the caster wheel 18 and the height of the bearing bracket 17. It should preferably be such that the caster wheel 18 protrudes outwardly from the flange portion 19 by approximately 10–20 mm, while the wheel axis is located inside the recess 20.

The bearing bracket 17 has a conventional dish-shaped base portion 28 and two spaced upstanding leg portions 29 of generally triangular outline. In the area of the distal extremities of the leg portions 29 are arranged aligned bores which hold a bearing pin 31 for the caster wheel 18. The two extremities of the bearing pin 31 are fixedly riveted to the leg portions 29. The non-rotatable bearing pin 31 thus forms a journal or bearing 32 for the caster wheel 18 which has a matching through bore for this purpose. As can best be seen in FIG. 3, the outline of the leg portions 29 is skewed with respect to the vertical axis of the swivel bearing 27, so that the horizontal axis of the bearing 32 is rearwardly offset from the swivel axis.

The swivel bearing 27 consists essentially of a journal rivet 33 and a ring of balls 34. The journal rivet 33 reaches with radial clearance through a bore in the center of the dishshaped base portion 28 of the bearing bracket 17 and is seated without clearance in an axially aligned bore of the bottom wall 26 of housing 16. On the lower end of the journal rivet (FIG. 3) is arranged a shoulder 35 by means of which the base portion 28 is frictionally retained. The upper extremity of the journal rivet 33, which protrudes from the upper side of the housing bottom wall 26, is deformed in a riveting or swaging operation, so that the widened diameter of the rivet end portion forms a rigid connection with the bottom wall 26.

In order to accommodate the ring of balls 34, the bottom wall 26 of housing 16 and the base portion 28 of bearing bracket 17 have formed in them matching ball races 36 and 37, respectively, in the form of annular grooves. The balls of the ring of balls 34 are circumferentially free within the ball races, i.e. they are not separated by a ball cage.

The mounting of the complete caster assembly 13 in the frame 38 of the suitcase requires an aperture 39 of a size and outline which correspond as closely as possible to the outline of the hood-shaped recess 20 of the caster housing 16. The four caster assemblies 13 on the transverse side of the suitcase 10 (FIG. 1) are arranged in such a way that they are all parallel, i.e. oriented in the same direction. The swivelability of all four caster wheels allows for the displacement of the suitcase along a comparatively small radius, despite the limited swivel range of the caster wheels themselves, when the two pairs of caster wheels are swivelled in opposite directions, as shown in FIG. 1, where the stippled line 40 indicates the curved displacement path of the suitcase 10.

Figure 7:
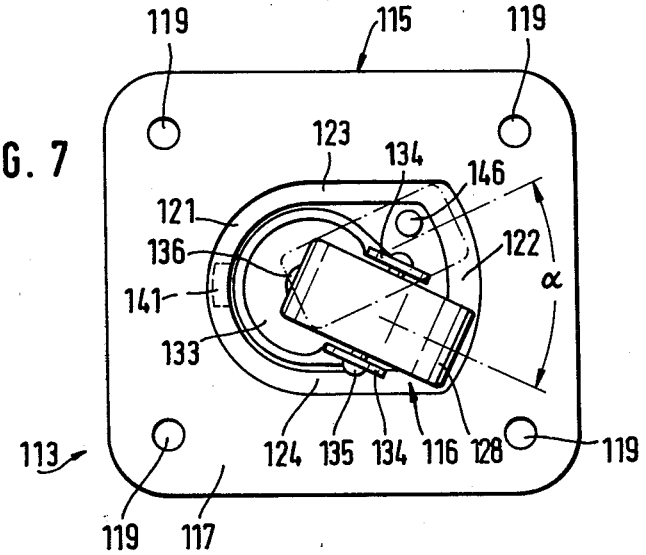
FIG. 7 shows a second embodiment of the invention, in the form of a caster assembly as seen from below.
Figure 8:
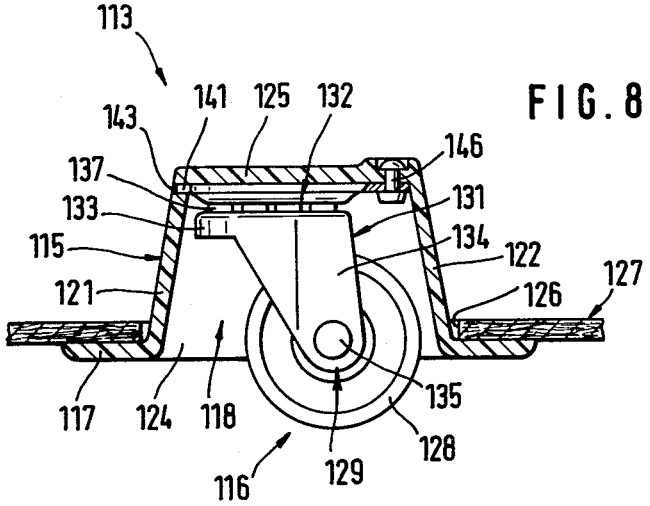
FIG. 8 is a longitudinal cross section of the caster assembly of FIG. 7.

In FIGS. 7 and 8 is shown a second embodiment of the invention which will be described below. To the extent that certain parts or component groups of this embodiment are not described below, it should be assumed that they are identical with, or at least similar to, corresponding parts or component groups of the first embodiment.

The caster assembly 113 of this embodiment is similar to the previously described embodiment, having a caster housing 115 and a caster wheel 116 which is swivelably connected to the housing. However, in this embodiment the caster housing 115 is preferably an injection-molded part, having a flange portion 117 which surrounds the central housing recess 118. The outline of the flange portion 117 is again generally rectangular, with rounded corners. In the area of these corners are arranged four attachment bores 119. As a rule, these bores are through-bores. The outer edge of the flange portion 117 is rounded off, as is the inner edge, where it adjoins the housing recess 118.

The housing recess 118 encloses the major portion of the caster wheel 116 in a hood-like fashion (FIG. 8), serving as a swivel support for the caster wheel 116. The recess 118 is again formed by four contiguous wall portions 121, 122, 123 and 124, and a bottom wall 125, being essentially the same as the housing recess 20 of the previously described embodiment. Similarly, the recess 118 of the caster housing 115 is received in a matching aperture 126 of the suitcase frame 127.

The caster wheel 116 consists of a previously described bearing 129 and a wheel 128 which, for minimum weight, is likewise preferably an injection-molded plastic part. The bearing bracket 131 which carries the caster wheel 116 is connected to the housing 115 by means of a swivel bearing 132 with a vertical axis which is located a distance ahead of the horizontal axis of the bearing 129, as is the case with most swivel casters.

The bearing bracket 131 of the caster assembly is substantially identical with the previously described bearing bracket 17, having a dish-shaped base portion 133 and two spaced upstanding leg portions 134 of generally triangular outline. In the area of their distal extremities, the leg portions 134 have aligned bores which hold a bearing pin 135 for the caster wheel 128. Both extremities of the bearing pin 135 are riveted to the leg portions 134, thus making the bearing pin 135 non-rotatable. The latter and a matching bore in the wheel 128 form the bearing 129.

The swivel bearing 132 consists again of a journal rivet 136 and a ring of balls 137. The journal rivet 136 reaches with radial clearance through a bore in the center of the dish-shaped base portion 133 of the bearing bracket 131 and is seated without clearance in an axially aligned bore of a stationary journal plate 138. As in the previously described embodiment, the lower extremity of the journal rivet 136 has a shoulder (not visible in FIG. 8) by means of which the base portion 133 is frictionally retained. The upper extremity of the journal rivet 136 protrudes from the upper side of the bottom wall 125, where it is deformed in a riveting operation to form a rigid connection with the bottom wall 125. The ring of balls 137 is again retained in a ball race on the upper side of the base portion 133 (not seen in FIG. 8) and a matching ball race 139 which is formed in the swivel plate 138. The balls 137 are free balls, i.e. not separated by a ball cage.

Figure 9:
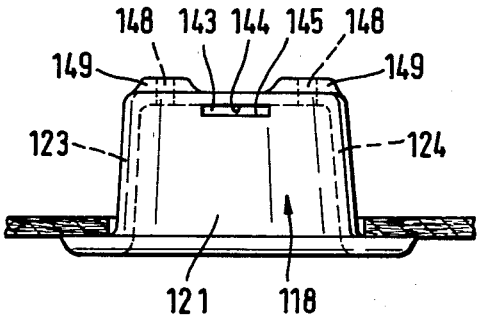
FIG. 9 shows the caster housing of the caster assembly of FIG. 7, as seen in the longitudinal sense.

The journal plate 138 is designed for attachment to the bottom wall 125 of the caster housing 115. Once attached, it serves as the stationary part of the swivel bearing 132. For this purpose, the journal plate 138 consists of a plate portion of circular outline for the ball race 139 and a plate extension 142, the two portions together forming a plate outline which matches the outline of the bottom wall 125, as determined by the wall portions 121, 122, 123 and 124. In addition to this outline, the journal plate 138 has a protrusion 121 on the midportion of its circular outline, designed to engage a cooperating slot 143 of the front wall portion 121, where the latter adjoins the bottom wall 125. As can be seen in FIG. 9, the slot 143 is of rectangular cross section, having upper and lower abutment faces 144 and 145, respectively, for the positioning of the protrusion 141 of the journal 138. On the side of the plate extension 142 are further arranged two rivets 146 which engage bores 147 in the plate extension 142 and aligned bores 148 in the bottom wall 125 of housing 111, thereby rigidly connecting the journal plate 138 to the caster housing 115. The rivet heads on the upper side of the caster housing 115 are preferably recessed into eye portions 149 of the bottom wall 125 (FIG. 8).

Lateral impact forces on the wheel 128 tend to produce tilting moments on the journal plate 138. Depending upon the directions of these impact forces, the plate 138 will transmit them through its protrusion 141 to the lower abutment face 145 of slot 143 and/or via the rivets 146 in the plate extension 142 to the bottom wall 125. Vertical forces on the wheel 128, especially the much greater gravity forces of the suitcase and its contents, are distributed over the entire surface of the journal plate 138 and directly transmitted to the bottom wall 125 as a vertical contact pressure.

Figure 12:
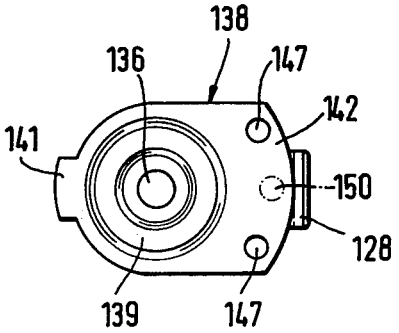
FIG. 12 shows the subassembly of FIG. 11 in a plan view.

In the case of smaller and less heavy suitcases, where correspondingly reduced forces have to be transmitted between the caster wheel 116 and the caster housing 115, it may be sufficient to replace the two rivets 146 on opposite sides of the center plane of the caster wheel 116 with a single rivet in the center plane of plate 138, as indicated in FIG. 12 by the dotted hole 150.

Figure 10:
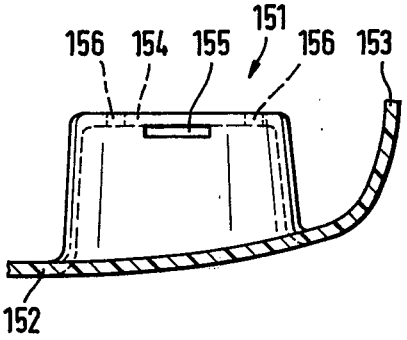
FIG. 10 shows a modified caster housing, likewise seen in the longitudinal sense.
Figure 11:
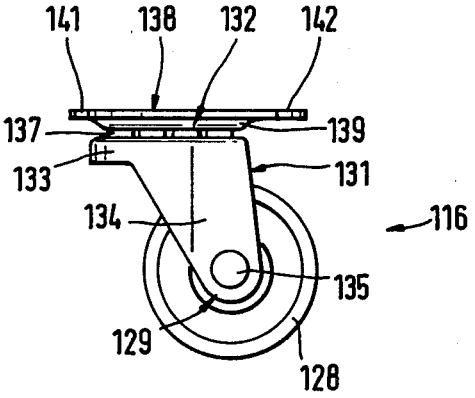
FIG. 11 is an elevational view of a caster sub-assembly, ready for attachment to the bottom wall of a caster housing (not shown)

The caster assembly 113 of FIGS. 7 and 8 with its separate caster housing 115 is particularly suitable for use on softwalled suitcases, where the housing recesses 118 of the four caster assemblies 113 engage matching apertures 126 of the suitcase frame 127 to which the flange portions 117 of the housings 115 are attached by rivets (not shown), for example. The same configuration can also be used with stiff-shell suitcases whose bottom shell and cover shell are produced from a flat sheet in a drawing or press-forming operation, with or without heat application, and where the side walls of the bottom and cover shells do not permit a further drawing operation for the forming of appropriate integral recesses for the caster assemblies. However, when the shell halves of such stiff-shell suitcases are produced as injection-molded parts or formed from easily drawable stock, it is also possible to obtain the caster housings as integral wall portions of the shell halves themselves. Such a caster housing 151 is shown in FIG. 10. It is arranged in the narrow wall portion 152 of the shell side wall, near the transition radius to the large outer wall 153 of the suitcase. The omission of a flange portion for the attachment of the housing 151 to the suitcase frame makes it possible to arrange the housing recess at a location in the suitcase frame where the recess opening does not coincide with a horizontal plane. The bottom wall 154 of the caster housing 151, however, is preferably horizontal, i.e. perpendicular to the separation plane of the suitcase shells, in order to assure that the swivel axes of the four swivelable caster wheels 116 are oriented parallel to one another. All other features of the integral caster housing 151 correspond to those of the caster housing 115 of the previously described embodiment. It is designed for the insertion of the same caster wheels 116 and is provided with a slot 155 which corresponds to the slot 143 for the protrusion 141 of the journal plate 138. This slot 155, as well as the bores 156 for the final rivet connection between the journal plate 138 and the bottom wall 154 may be produced as part of the operation which shapes the integral caster housing 151, or they may be produced separately in a subsequent operation.

It should be understood that the attachment of the caster wheel subassembly to the bottom wall of the caster housing, as proposed in FIGS. 7 and 8, for example, need not involve the rivets 146, but can be accomplished by means of screws instead, using preferably self-tapping screws which engage smaller bores, or blind bores, in the bottom wall 125 of the caster housing 116. Alternatively, it is also possible to attach the journal plate 138 to the caster housing 116 by means of integral prongs which extend downwardly from the housing bottom wall 154, in alignment with the holes 147 and/or 150 of the journal plate 138. Following the insertion of the journal plate 138 of the caster subassembly over these prongs, the latter are then simply swaged or welded against the plate 138, in a way which is similar to the setting operation of the rivets 146.

Figure 13:
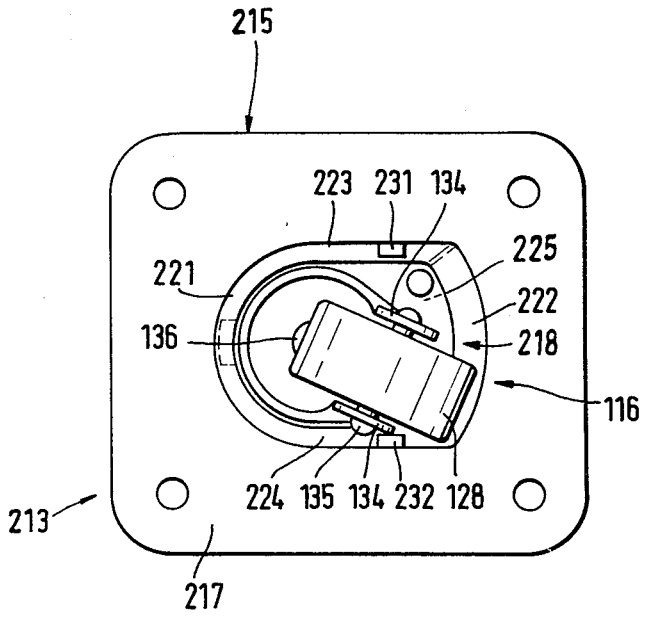
FIG. 13 shows a caster assembly with a further modified caster housing, as seen from below.

In FIG. 13 is shown a modification of the caster assembly of FIGS. 7 and 8, the modification concerning an abutment configuration between the side walls of the housing recess and the swivelable non-rotating parts of the caster assembly consisting of the bearing bracket and its bearing pin. The purpose of such an abutment configuration is to prevent the caster wheel from rubbing against the caster housing in its extreme swivel positions. Parts and component assemblies which have the same reference numerals as the embodiment of FIGS. 7 and 8 are the same as in that embodiment.

The two side walls 223 and 224 of the housing recess 218 are provided with abutment ribs 231 and 232, respectively, the two ribs extending from the vicinity of the flange portion 217 to the bottom wall 225 of recess 218. The ribs 231 and 232 may have flat or rounded abutment faces. These faces may extend parallel to the inclined side walls 223 and 224, or they may be perpendicular to the bottom wall 225, as shown in the drawing, allowing only for the required mold taper. The location of the abutment ribs 231 and 232 is such that they cooperate with the leg portions 134 of the bearing bracket 131, engaging the most distal edges of the leg portions 134.

It should be understood, of course, that there are alternative ways of obtaining an abutment between the side walls of the housing recess and the swivelable parts of the caster assembly. It is possible, for example, to simply extend the leg portions 134 of the bearing bracket 131 beyond their distal edges and/or to bend these edges outwardly, for abutment contact with the recess side walls 223 and 224. It is also possible to extend the length of the bearing pin 135 until its extremities fulfill the desired abutment function. The rounded rivet heads would then have to be replaced by transverse swaging indentations at the bearing bracket 131, in order to secure the pin 135 in the axial sense. Alternatively, it is also possible to secure the extending bearing pin by means of commercially available self-retaining shaft caps, using spacer washers between the caps and the leg portions 134, if necessary.

It should also be understood that the foregoing disclosure describes only preferred embodiments of the invention and that it is intended to cover all changes and modifications of these examples of the invention which fall within the scope of the appended claims.

I claim the following:

1. A caster assembly for suitcases and the like comprising in combination:

a caster housing designed to form a portion of a horizontal floor-proximate wall of a suitcase, the caster housing forming a downwardly open housing recess bounded by upstanding walls and a substantially horizontal bottom wall of the caster housing;

a bearing bracket arranged in the housing recess and rotatably connected to the bottom wall of the caster housing by means of a swivel bearing which defines a vertical swivel axis; and a caster wheel rotatably connected to the bearing bracket by wheel bearing means, so that the bearing bracket, the caster wheel and the wheel bearing means form a swivelable subassembly, the wheel bearing means defining a horizontal bearing axis which is located a distance behind the swivel axis in the sense of caster advance and spaced from the housing bottom wall such a distance that a major portion of the caster wheel is received within the housing recess; and wherein the upstanding walls of the caster housing include two side walls on opposite sides of and equidistant from the vertical swivel axis, the side walls and the swivelable subassembly defining abutmment means limiting the swivel range of the subassembly to an acute swivel angle, thereby making it possible to accommodate a caster wheel of comparatively large diameter in the housing recess.

2. A caster assembly as defined in claim 1, wherein the swivelable subassembly has dimensions of such magnitude that its swivel range between the side walls of the caster housing is limited to an angle of no more than 60 degrees.

3. A caster assembly as defined in claim 1, wherein the abutment means between the side walls of the caster housing and the swivelable subassembly include rib-like protrusions on the side walls which cooperate with exterior, oppositely facing surfaces of the bearing bracket.

4. A caster assembly as defined in any one of claims 1 through 3, wherein the caster housing is formed as an integral portion of said floor-proximate wall of the suitcase.

5. A caster assembly as defined in any one of claims 1 through 3, wherein the caster housing is a part which is arranged for attachment to said floor-proximate wall of the suitcase, the caster housing having the shape of an inverted pan with a circumferential flange portion, adapted to be inserted into a matching opening of said suitcase wall and to be attached to the latter by means of said flange.

6. A caster assembly as defined in claim 5, wherein the caster housing is a die-formed sheet metal part, and the housing recess is a deep-drawn formation of the part.

7. A caster assembly as defined in claim 6, wherein the swivel bearing connecting the bearing bracket to the bottom wall of the caster housing includes a ring of balls which is retained between two horizontal ball races by a central journal rivet;

the upper ball race is defined by the bottom wall of the caster housing; and the lower ball race is defined by a base portion of the bearing bracket.

8. A caster assembly as defined in any one of claims 1 through 3, wherein the swivel bearing connecting the bearing bracket to the bottom wall of the caster housing includes a ring of balls which is retained between two horizontal ball races by a central journal rivet;

the upper ball race is defined by a substantially horizontal stationary journal plate which is supported by the bottom wall of the caster housing; and the lower ball race is defined by a base portion of the bearing bracket.

9. A caster assembly as defined in claim 8, wherein the journal plate and the caster housing define attachment means which include a horizontal protrusion on the periphery of the journal plate and a cooperating matching slot in an upstanding wall portion of the caster housing adjacent to its bottom wall, as well as a fastening means attaching the bearing plate to the bottom wall at a place which is located substantially diametrally opposite to said peripheral protrusion.

10. A caster assembly as defined in claim 9, wherein the peripheral protrusion and the cooperating slot of the attachment means are located centrally in front of the swivel bearing in the sense of caster advance; and the fastening means is in the form of at least one rivet which is arranged behind the swivel bearing.

* * * * *